US007021005B1

(12) United States Patent
Curry

(10) Patent No.: US 7,021,005 B1
(45) Date of Patent: Apr. 4, 2006

(54) GATE OPERATOR

(76) Inventor: John C. Curry, 12547 Denton Ave., Hudson, FL (US) 34667-7510

( * ) Notice: Subject to any disclaimer, the term of this patent is extended or adjusted under 35 U.S.C. 154(b) by 27 days.

(21) Appl. No.: 10/865,392

(22) Filed: Jun. 10, 2004

Related U.S. Application Data

(63) Continuation-in-part of application No. 10/402,656, filed on Mar. 31, 2003, now abandoned.

(51) Int. Cl.
*E05F 11/54* (2006.01)

(52) U.S. Cl. ..... 49/358; 49/49

(58) Field of Classification Search ..... 49/49, 49/358, 324, 139, 140, 359; 267/291, 293
See application file for complete search history.

(56) References Cited

U.S. PATENT DOCUMENTS 1,631,416 A * 6/1927 Howard ..... 49/358
1,694,431 A 12/1928 Russell et al.
2,827,284 A 3/1958 Bunzl
3,606,699 A 9/1971 Robinson, Jr.
3,775,906 A 12/1973 Dougherty
4,520,592 A 6/1985 Holloway
4,672,773 A 6/1987 Bilt
4,754,572 A 7/1988 Bilt
4,916,860 A 4/1990 Richmond et al.
5,076,012 A 12/1991 Richmond et al.
5,101,595 A 4/1992 Rhoades
5,170,585 A 12/1992 Wen

* cited by examiner

*Primary Examiner*—Gregory J. Strimbu
(74) *Attorney, Agent, or Firm*—David Kiewit

(57) ABSTRACT

A gate operator in a first configuration opens and closes a gate that swings about an upstanding pivotal axis. In a second configuration the gate operator opens and closes a gate that extends and retracts along a straight line. A motor-driven wheel extends from the bottom of an open-bottomed enclosure and is perpendicular to the gate in the first configuration and parallel to the gate in the second configuration. The wheel is driven by a reversible DC motor. Turning a jack screw in a first direction increases the bias on an adjustable compression spring so that the weight of the gate is transferred to the wheel and rotation of the jack screw in an opposite direction shifts weight from the wheel to the gate.

6 Claims, 6 Drawing Sheets

GATE OPERATOR

CROSS REFERENCE TO RELATED APPLICATIONS

This application is a continuation-in-part of the inventor's U.S. Ser. No. 10/402,656, filed on Mar. 31, 2003 and abandoned on Sep. 20, 2004.

BACKGROUND OF THE INVENTION

1. Field of the Invention

This invention relates, generally, to devices that open and close gates and other vertical panel closures. More particularly, it relates to a gate operator that operates gates of differing types.

2. Description of the Prior Art

Gates are commonly either pivotally mounted so that they swing open and closed about a vertical pivotal axis or longitudinally mounted so that they extend or withdraw along a straight line. A prior art operator for a swing gate is commonly different than the operator for a longitudinally-opening gate. In a property having both types of gates, the maintenance crew must store spare parts and learn how to maintain both types of gates. It would therefore be advantageous if one universal operator could be provided to operate both a swing gate and a longitudinally-mounted gate.

Many gates are mounted over an irregular surface that may comprise rough and uneven terrain such as a transition from a paved surface to a lawn, or over the ruts of a dirt road. Prior art operators have commonly avoided this problem by either providing a smooth flat surface adjacent the gate, or, in the case of a longitudinal gate or sliding closure, by providing tracks to carry the moving gate panel.

There is a clear need, then, for a gate operator of rugged construction that requires little maintenance, and for a gate operator designed so that the weight of the gate can easily be shifted onto the gate operator, or vice versa by means permitting the gate operator to traverse an irregular surface.

SUMMARY OF THE INVENTION

A preferred apparatus for opening and closing a gate of either the swinging or longitudinally mounted version comprises a wheel mounted within an enclosure for rotation about a horizontal axis. If the gate is of the type that swings about an upstanding pivotal axis, the enclosure of the preferred operator is attached to the gate so that the wheel is mounted for rotation in a plane substantially perpendicular to a plane of the gate. The same sort of structure may be employed to open and close a longitudinally-extending gate. The only difference is that the wheel is mounted for rotation in a plane parallel to the plane of the gate in that configuration. That is, the enclosure is simply rotated ninety degrees (90°) from its swinging gate orientation. Thus, one aspect of the invention is that it provides a universal gate operator for selectively operating either a swing gate or a longitudinally-opening gate.

As is known in the art of closure operators, various combinations of power sources, drive motors and speed reducers may be used to turn the wheel. In a preferred embodiment the drive train comprises a rechargeable battery; a reversible electric motor; a two-stage speed reducer comprising both a belt-and-pulley portion and a chain-driven portion; and a controller operable responsive to an input from a remote command device. Those skilled in the art will appreciate that some of these features can be dispensed with and, moreover, that there are many known equivalents for various of these components. For example, the preferred speed reducer could be replaced with one comprising a gear train, or with one having two belt-and-pulley or two drive chain portions.

The preferred apparatus also comprises a spring-supported lifting mechanism for shifting weight from the gate to the wheel and for shifting weight from the wheel to the gate. Thus, the invention provides a gate operator that does not add any weight to the gate and that can be adjusted to support at least some of the weight of a gate. In preferred embodiments the lifting mechanism is interposed between the wheel and the enclosure and comprises an elongated jack screw set in a vertical orientation. In some preferred embodiments an axis of the jack screw is directly above, and aligned to intersect, the axle upon which the wheel turns. In other embodiments, intended primarily for use with swinging gates, the axis of the jack screw may be positioned further from the enclosure wall that is attached to the gate than is the axle in order to null out any twisting effect on the gate.

Regardless of the choice of jack screw axis position, a coil spring is preferably disposed between a drive deck to which the axle is journaled and a jack screw-follower slidably and non-rotatably received within a vertically disposed tubular member fixedly attached to the drive deck. This arrangement may comprise the depicted combination of a square nut slidably movable within a tube having a square cross-section, hereinafter referred to a "square tube". This spring biases the wheel into contact with a supporting surface and thus functions to allow the gate operator to move the gate over an irregular surface.

Accordingly, rotation of the elongate screw in a first direction causes the screw follower to travel downwardly along the extent of the elongate screw, thereby compressing the spring. By increasing the compressive force on the spring, an upward reactive force is imposed on the elongate screw, which in turn is transmitted to the housing and thereby to the gate. Rotation of the elongate screw in the opposite direction causes the screw-follower to travel upwardly along the extent of the elongate screw, thereby decompressing the spring. The closure is displaced upwardly when the elongate screw is rotated in the first direction, thereby transferring weight from the gate to the wheel. The closure is displaced downwardly when the elongate screw is rotated in the second direction, thereby transferring weight from the wheel to the gate. The jack screw may be turned far enough in the second direction to entirely lift the wheel off the ground, thus allowing the closure to be operated manually when the operator fails due to a low battery state or to some other operational condition.

Although it is believed that the foregoing rather broad recital of features and technical advantages may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed herein as a basis for designing other arrangements for carrying out the same purposes of the present invention. Those skilled in the art will realize that such equivalent constructions are within the spirit and scope of the invention in its broadest form. Moreover, it may be noted that various embodiments of the invention may provide various combinations of the hereinbefore recited features and advantages of the invention, and that less than all of the recited features and advantages may be provided by some embodiments.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
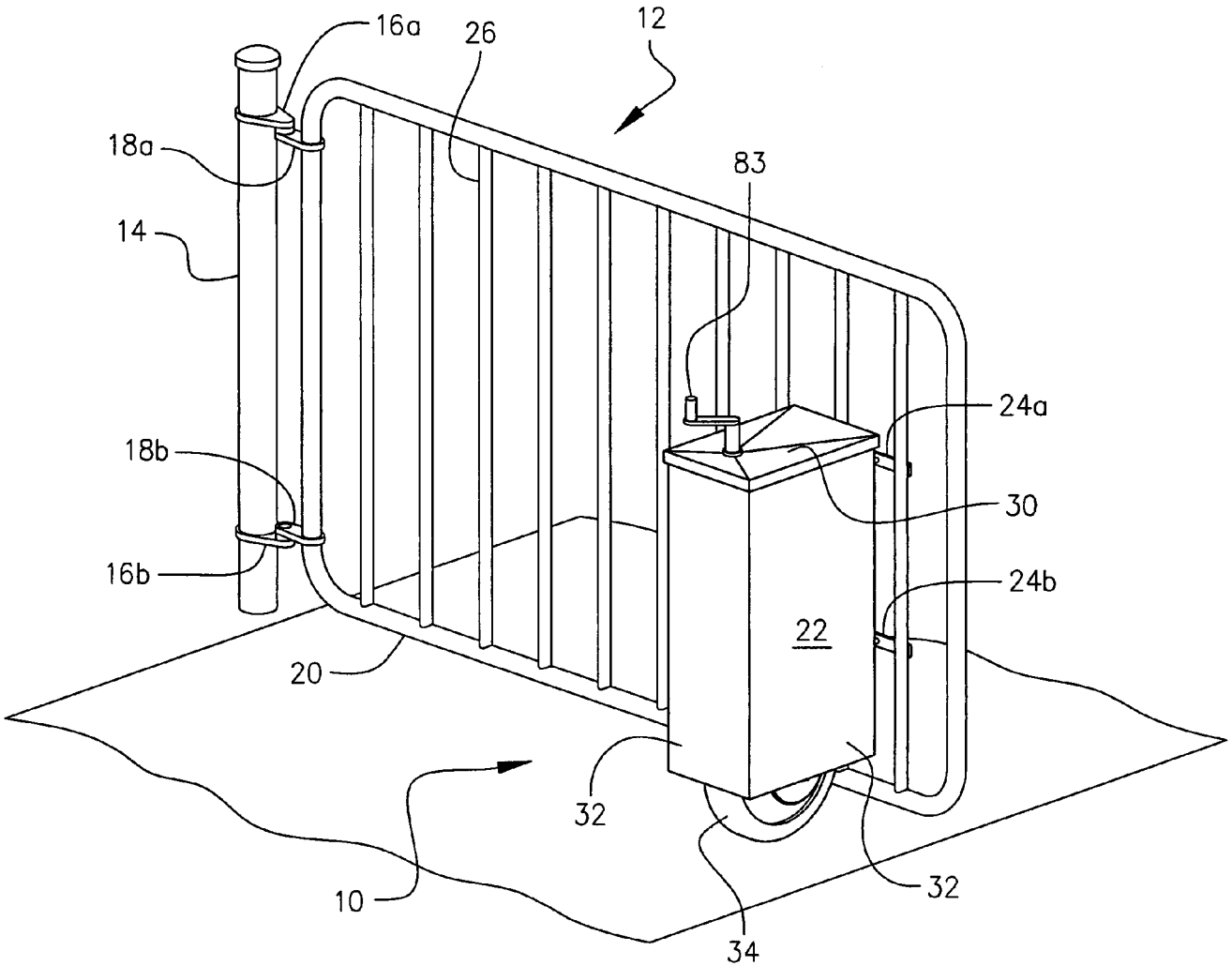
FIG. 1 is a perspective view depicting an operator of the invention connected to a swing gate where the swing gate is in a closed configuration.

In FIG. 1 the reference numeral 10 denotes an illustrative embodiment of a gate operator of the present invention being used to operate a swinging gate 12 pivotally secured in a well-known way to a post 14 which is mounted in a post hole in a conventional manner. In this arrangement a pair of hinges 16*a*, 16*b* is secured to the post 14 at opposite ends thereof and a mating pair of hinges 18*a*, 18*b* is secured to a frame 20 of the swing gate 12. A preferred weather-proof enclosure 22 is secured to the swing gate by any suitable clamping means. The method of such mounting is adapted to the particular structure of the swing gate to which the enclosure 22 is to be mounted.

Figure 2:
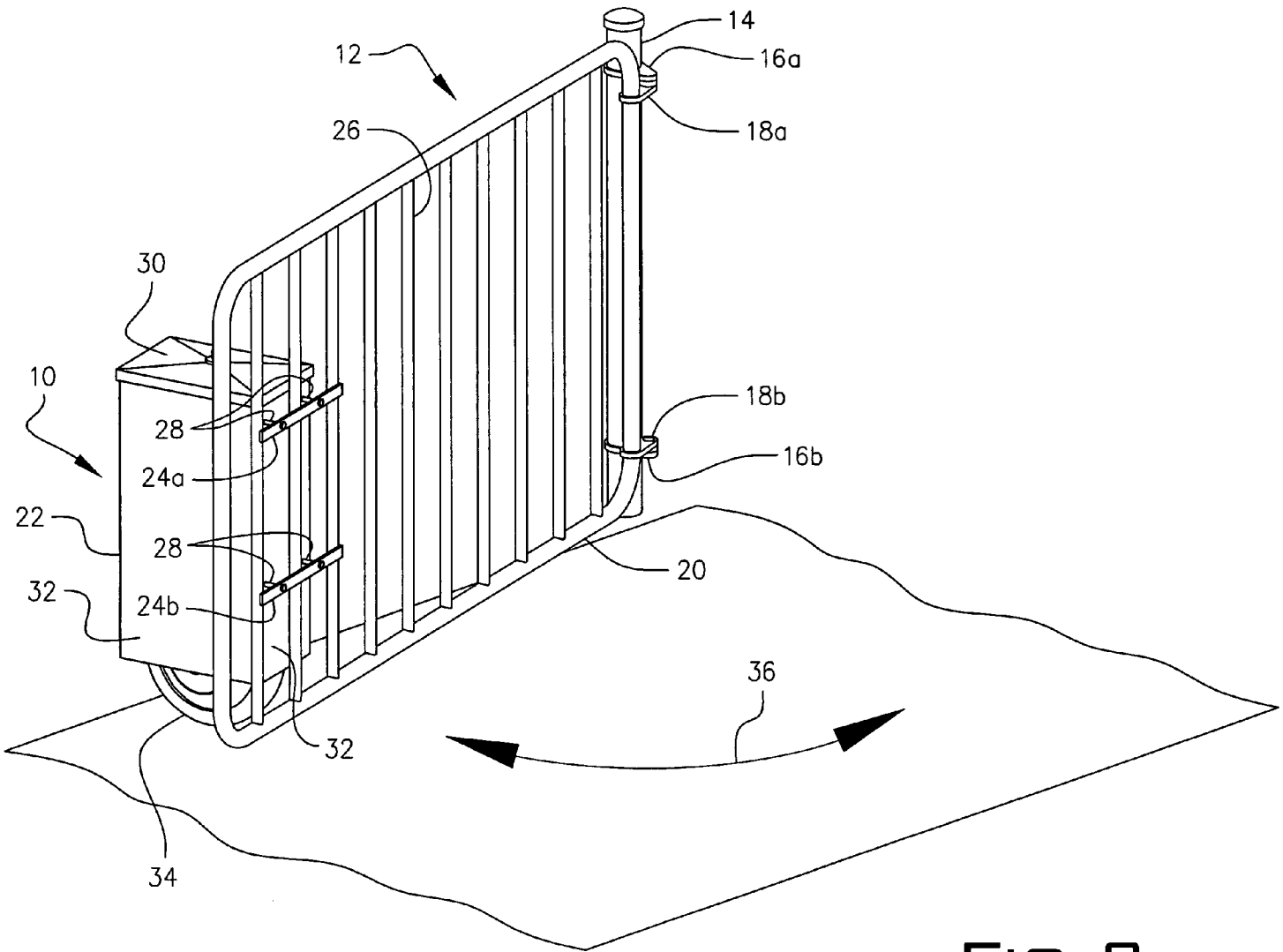
FIG. 2 is a perspective view of the operator depicted in FIG. 1 when the swing gate is in its open configuration.

As best understood in connection with FIG. 2, for a swing gate of the depicted type, a pair of links 24*a*, 24*b* is positioned behind upright frame members, collectively denoted as 26, and these links are secured to the enclosure 22 by suitable clamping members. Those skilled in the art will recognize that many sorts of fixture hardware can be used to attach the operator to a gate. In the drawing these clamping members are depicted as bolts, collectively denoted as 28, that engage threaded portions 29 of the housing 22. Other attachment approaches include, but are not limited to brackets or housing portions directly welded to the gate.

The preferred weather-proof enclosure 22 is a generally rectangular, open-bottomed structure as depicted comprising a top closure member 30, walls 32, and a wheel 34. In the embodiment of FIGS. 1 and 2, the wheel 34 is mounted for rotation about an axle 35 parallel to the plane of the gate 12. Thus, the wheel 34 rotates in a plane perpendicular to the plane of the gate 12. Counterclockwise rotation of the wheel 34, when in the position depicted in FIG. 1, causes the gate 12 to swing about the post 14 toward the FIG. 2 position, while clockwise rotation of the wheel 34, when in the FIG. 2 position, causes the gate 12 to swing about the post 14 toward the FIG. 1 position as the wheel moves along an arc indicated by the curved double-headed arrow 36 in FIG. 2.

Figure 3:
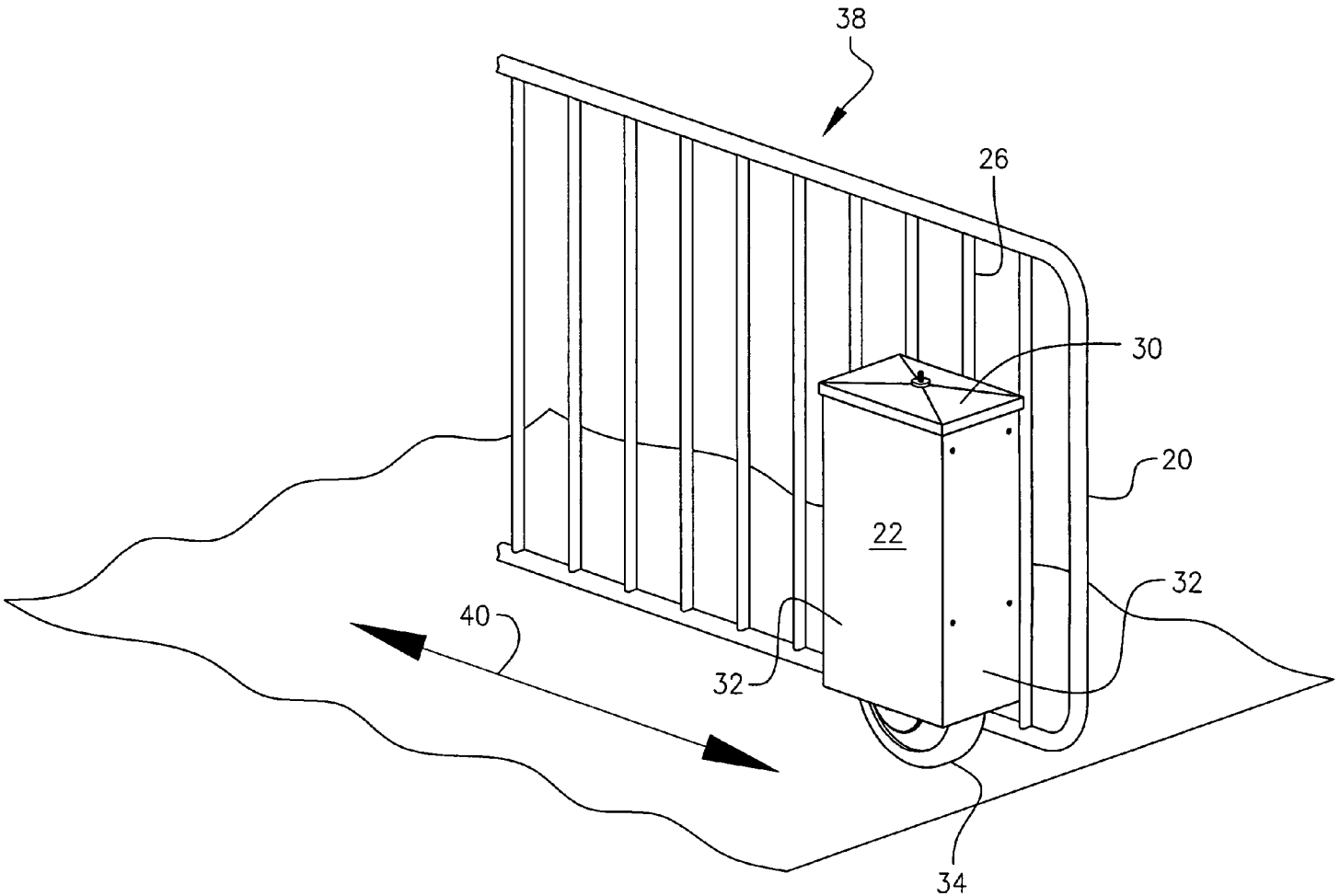
FIG. 3 is a perspective view depicting the operator connected to a longitudinally-opening gate where the longitudinally-opening gate is in a closed configuration.

In the longitudinally-opening gate embodiment depicted in FIG. 3, the operator 10 is rotated ninety degrees about a vertical axis from swing gate mounting orientation depicted in FIGS. 1 and 2. This change in orientation is preferably provided for by having at least two mutually perpendicular clamping member receivers, such as the threaded fittings 29 for receiving clamping members, which may be the same links 24*a,b*, and bolts 28, used in the first-described mounting in substantially the same way as was done for the swing gate 12. In the longitudinal-gate setting, the axle 35 upon which the wheel 34 is mounted is perpendicular to the plane of the longitudinally-opening gate 38 so that the wheel 34 rotates in a plane parallel to the plane of the gate. Counterclockwise rotation of the wheel 34 causes travel to the left in the depiction of FIG. 3, while clockwise rotation of the wheel causes travel to the right. This back-and-forth motion is indicated with the straight double-headed directional arrow 40 in FIG. 3.

Figure 4:
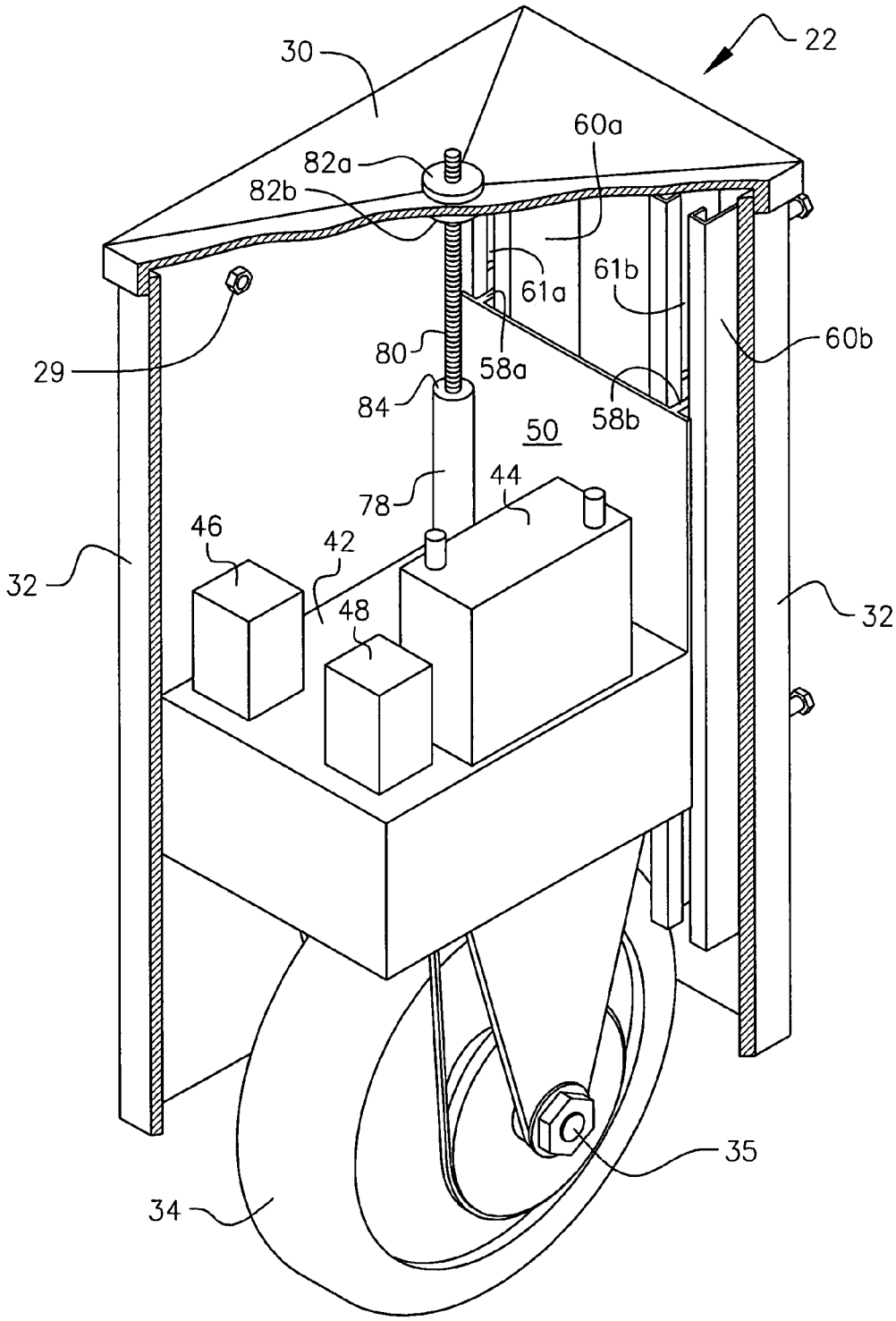
FIG. 4 is a largely schematic, broken away view depicting the interior of a preferred operator of the invention.

Some of the preferred components housed within the weather-resistant enclosure 22 are depicted in the cut-away view of FIG. 4. A horizontally disposed drive deck 42 supports a battery 44, a controller 46 for selecting the direction of motion, and a battery charger 48. The drive deck 42 may be mounted in a cantilevered relation to the vertically disposed support plate 50 which, in turn is movably mounted for reciprocation in a vertical plane by any of a variety of known movable attachment arrangements which may comprise a pair of laterally spaced apart guide rails of the sort commonly used with large drawers, or upper 58*a*, 58*b* and lower 58*c*, 58*d* pairs of laterally spaced apart barn door trolleys housed within upstanding channel members 60*a*, 60*b* having respective slots (e.g., 61*a*) for receiving the trolleys. Although the drawing depicts the vertical reciprocation mechanism disposed at one end of the drive deck 42, those skilled in the arts will recognize that channels and rollers, or other suitable vertical reciprocation mechanisms, may be located elsewhere.

Figure 5:
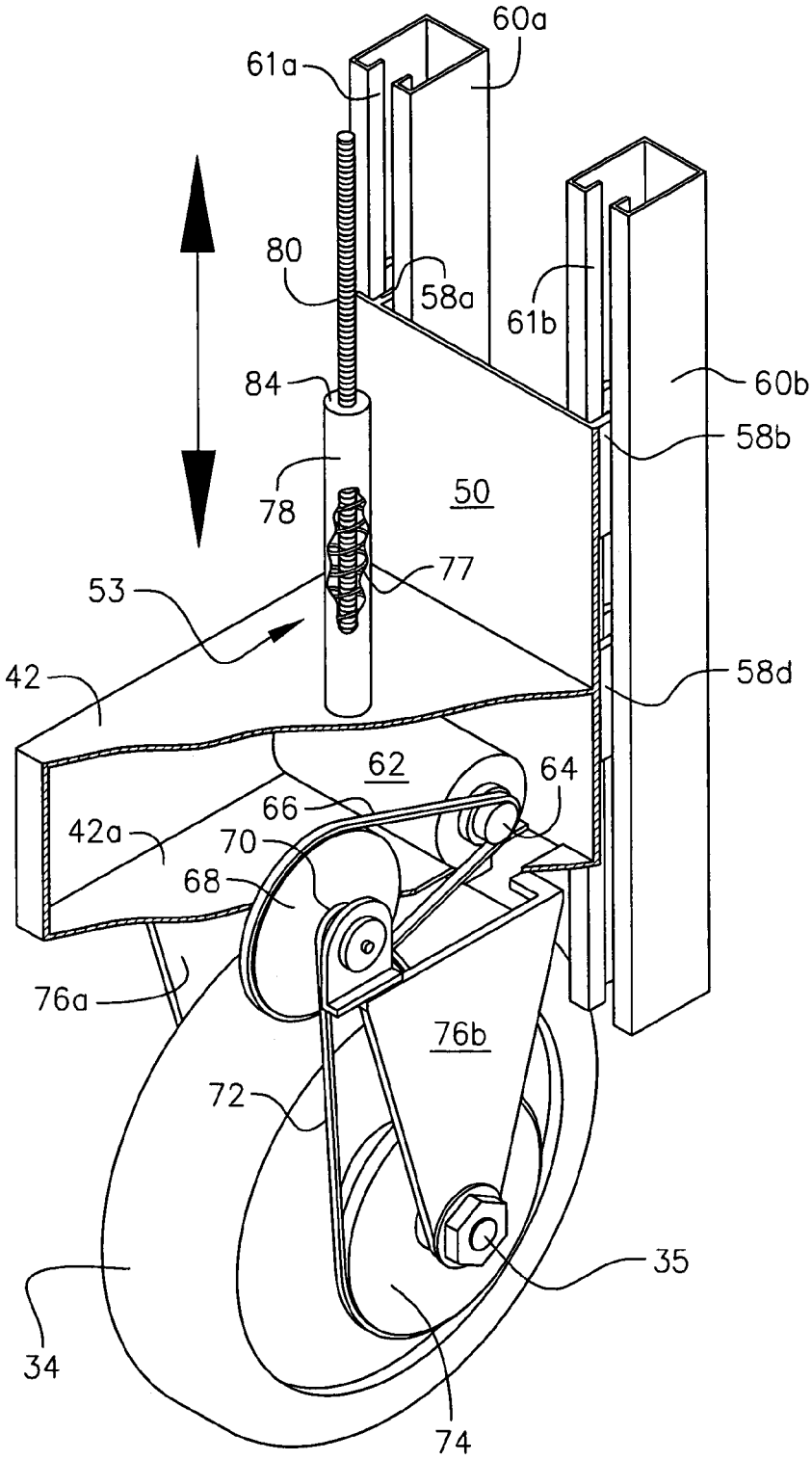
FIG. 5 is a perspective view of the parts depicted in FIG. 4, the view comprising additional parts broken away to reveal further structural details of the operator.

The preferred drive deck 42 is cut away in FIG. 5 so that the parts housed therewithin may be seen. A reversible DC motor 62 has a power take-off shaft 64 to which is connected a belt 66 that wraps around a pulley 68. The diameter of the pulley 68 is greater than the diameter of the power take-off shaft 64 so that the pulley rotates slower than the power take-off shaft by a ratio equal to the ratio of diameters. The pulley 68 is mounted for rotation about a hub 70 which is engaged by a sprocket chain 72 which also engages a second hub 74 which is mounted on the axle 35 of the wheel 34. The diameter of the second hub 74 is greater than the diameter of the first hub 70 so that the second hub 74 rotates slower than does the first hub 70 by a ratio equal to the ratio of diameters. This particular speed reducer arrangement is not critical to the invention and those of ordinary skill in the mechanical arts may substitute other speed reducing methods without departing from the scope of this invention. For example, a gear-based speed reducer could also be employed.

In this way, the direction of rotation of wheel 34 is determined by the direction of operation of reversible motor 62.

Flanges 76*a*, 76*b* extend from a bottom wall 42*a* of the drive deck 42 and their respective lower ends engage the axle 35 upon which wheel 34 is mounted.

Figure 6:
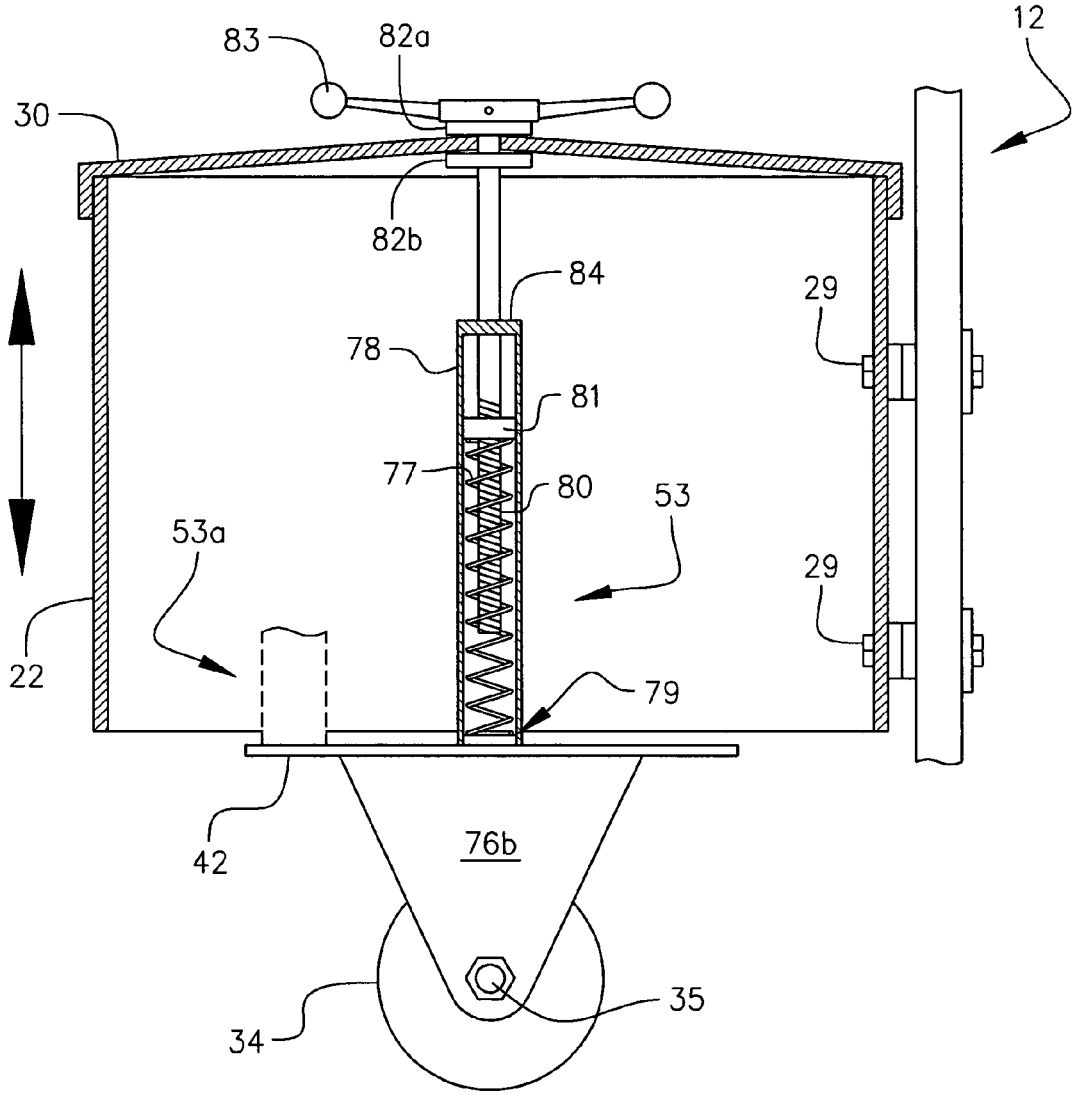
FIG. 6 is a sectional view depicting a mechanism for shifting the weight of a gate onto the gate operator.

As perhaps best understood in connection with the schematic depiction of FIG. 6, a spring suspension 53 comprising an adjustable compression spring 77 is preferably interposed between the wheel 34 and the enclosure 22 in order to allow the operator 10 to move a gate over uneven terrain. A preferred suspension 53 may comprise an elongate, partially externally threaded jack screw 80 having an unthreaded upper end thrust against and journaled for rotation within an upper closure member 30 of the enclosure 22 at a fixed axial position along the jack screw. This may be simply done using the arrangement shown in FIG. 6 in which a lower washer 82*b* is welded to the upper portion of the jack screw 80 to rotate conjointly with it, leaving an upper end portion of the jack screw to stick up through an aperture in the top closure member 30, which is fixedly attached to the walls 32 of the enclosure 22 by bolts, weldments, or other suitable attachment means (not shown). Those skilled in the art will recognize that the provision of an enclosure top 30 initially separate from the walls 32 is a matter of convenience and that one could choose to form the entire enclosure 22 from a single piece of material. An upper washer 82*a* can be used to cover the hole and a suitable crank handle 83 can be attached to the upper end of the screw.

The lower, threaded end of the jack screw 80 engages a screw-follower 81 arranged to press on an upper end of a coil spring 77. In the depicted arrangement, the screw-follower 81 comprises a square nut housed within a square tube spring housing 78 fixedly attached in an upstanding relation to the drive deck 42. Those skilled in the mechanical arts will recognize that there are many other functionally equivalent arrangements for providing an adjustably loaded suspension. For example, a different screw-follower arrangement, such as a nut having a lobe or ear projecting outwardly through a slot in a longitudinally slotted tube could be directly substituted. Other more extensive changes involving different sorts of springs and loading mechanisms will also come to the skilled artisan's mind.

In operating the suspension depicted in FIG. 6, turning the hand wheel 83 in a first direction rotates the screw 80 so as to drive the square nut 81 downward to compress the adjustable compression spring 77 against a lower spring seat 79, thereby applying a downwardly directed force to the drive deck 42 and exerting an increased load on the drive wheel 34. Because the wheel 34 is ground supported and cannot move downward, the support plate 50, barn door trolleys 58, and enclosure 22 are therefore displaced upward. Such upward displacement transfers weight from an operated gate to the drive wheel.

To reduce the weight on the wheel 34 and to transfer more load to the gate, the screw 80 is rotated in the opposite direction. When this happens, the screw-follower 81 travels upward, allowing expansion of the adjustable compression spring 77, which thereby reduces the amount of bias exerted by the adjustable compression spring 77, and allows the enclosure 22 to be lowered. Continuing to rotate the jack screw in this direction after the screw-follower 81 contacts an upper travel stop 84 will raise the wheel clear of the ground.

The depicted structure, which has the suspension 53 disposed immediately above the axle, is highly versatile and can be used on both kinds of common gates. Switching it from one type of gate to another is a very simple undertaking. An alternate embodiment of the invention, intended primarily for use with gates of the swinging variety, uses a vertically oriented suspension 53*a*, depicted in phantom in FIG. 6, more distal from that wall of the enclosure 30 that is clamped to the gate 12 than is the axle 35. This alternate embodiment can null out any twisting effects imposed on the gate by the operator.

Thus, the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A gate operator for moving a gate over an irregular surface above which the gate is suspended, the operator comprising:

an enclosure having an upper closure portion and an open bottom;

a wheel mounted for rotation about an axle, the wheel depending below the bottom of the enclosure, the axle journaled to a drive deck vertically movable within the enclosure;

a reversible motor mounted on the drive deck in driving relation to the wheel;

at least one clamping member for clamping the enclosure to the gate; and a spring suspension disposed between the drive deck and the upper closure portion of the enclosure, the spring suspension comprising:

a vertically oriented jack screw journaled within the upper closure portion for rotation therewithin;

a screw follower threadably coupled to the jack screw and slidably received within a vertically oriented tubular member fixedly attached to the drive deck; and a spring disposed between the screw follower and the drive deck, the spring acting to bias the wheel downward, so that when the operator is used, the wheel is adapted to be forced into contact with the irregular surface beneath the gate.

2. A gate operator for moving a gate to which it is attached, the gate suspended above an irregular surface, the gate operator comprising:

a wheel rotatably mounted on an axle journaled to a drive deck vertically movable within an enclosure having a fixed upper closure;

a motor supported on the drive deck and drivingly coupled to the axle; and a spring suspension disposed between the drive deck and the fixed upper closure, the spring suspension comprising:

a vertically oriented jack screw journaled within the upper closure for rotation therewithin at a fixed position along an axis of the jack screw;

a screw follower threadably coupled to the jack screw and slidably received within a vertically oriented tubular member fixedly attached to the drive deck; and a spring disposed between the screw follower and the drive deck, the spring adapted to bias the wheel into contact with the irregular surface.

3. The gate operator of claim 2 wherein the screw follower comprises a square nut, the tubular member comprises a tube having a square cross-section and the spring comprises a coil spring captured within the square tube between the square nut and the drive deck.

4. The gate operator of claim 2 wherein the jack screw is journaled within a throughhole in the upper closure and wherein the fixed axial position of the jack screw is defined by a washer welded to the jack screw and bearing on a lower surface of the upper closure.

5. The gate operator of claim 2 wherein the enclosure comprises a plurality of mutually perpendicular clamping member receivers for selectively receiving respective clamping members for attaching the enclosure to the gate in one of two orientations so that the axle is parallel to a longitudinal axis of the gate in a first of the orientations, and the axle is perpendicular to the longitudinal axis of the gate in the second orientation.

6. The gate operator of claim 2 further comprising an upper stop disposed within the vertically oriented tubular member, the upper stop limiting motion of the screw-follower along the screw.

* * * * *